United States Patent [19]

Odet

[11] Patent Number: 4,830,234

[45] Date of Patent: May 16, 1989

[54] METERING POURING STOPPER FOR CONTAINER WITH THREADED NECK AND LATERAL HANDLE

[75] Inventor: Philippe Odet, Chasselay, France

[73] Assignee: Astra Plastique, Rhone, France

[21] Appl. No.: 209,485

[22] Filed: Jun. 20, 1988

[30] Foreign Application Priority Data

Jun. 25, 1987 [FR] France ..... 87 09571

[51] Int. Cl.[4] ..... B65D 5/72

[52] U.S. Cl. ..... 222/465.1; 222/109; 222/545; 222/569; 222/570; 53/490

[58] Field of Search ..... 222/109, 111, 153, 567–571, 222/545, 562, 546, 465.1; 141/380, 381; 385/901; 53/420, 490, 562

[56] References Cited

U.S. PATENT DOCUMENTS

| | | | |
|---|---|---|---|
| 2,763,402 | 9/1956 | Livingstone . | |
| 3,318,496 | 5/1967 | Ayotte et al. | 222/546 |
| 3,800,987 | 4/1974 | Kemp . | |
| 4,781,311 | 11/1988 | Dunning et al. | 222/153 |

FOREIGN PATENT DOCUMENTS

| | | |
|---|---|---|
| 0109704 | 5/1984 | European Pat. Off. . |
| 1239528 | 7/1960 | France . |

*Primary Examiner*—H. Grant Skaggs
*Attorney, Agent, or Firm*—Browdy & Neimark

[57] ABSTRACT

A metering pouring stopper comprising two elements of a moldable or injectable material which is at least somewhat flexible. One of these elements comprises a pouring lip which can be fastened to the free end to the threaded neck of the container, while the other element comprises a metering chamber and a threaded skirt to be screwed onto the threaded neck of the container. Since the threads of the necks of containers always have a predetermined, constant angular orientation, the two elements of the stop that can fit into one another have assembly detachable means which make it possible to assemble them temporarily before they are placed onto the container. Means are provided whereby the elements can be set and positioned angularly relative to one another by relative simple rotation of a fraction of a turn, this angular positioning being determined as a function of the predetermined and constant angular orientations of the threads of the neck of the container and of the closing element of the stopper so that, when the stopper is completely screwed onto the neck of the container, the pouring lip of the element bearing the pouring lip has the desired angular orientation diametrically opposite to that of the handle of the container.

5 Claims, 1 Drawing Sheet

METERING POURING STOPPER FOR CONTAINER WITH THREADED NECK AND LATERAL HANDLE

FIELD OF THE INVENTION

This invention relates to a metering pouring stopper for a container with a threaded neck and lateral handle, i.e., a stopper of a moldable or injectable material at least somewhat flexible and elastic such as a plastic, made up of two elements that can fit into one another, one element including a pouring lip intended to be fastened, by engagement, to the free end of the threaded neck of the container and a closing element including a metering chamber and a skirt threaded on the inside and able to be screwed on the threaded neck of the container.

BACKGROUND OF THE INVENTION

It is easy to understand that, when a container is provided with a pouring lip and a lateral handle, it is essential that after assembly of the metering pouring lip with the neck of the container, the pouring lip have, relative to the axis of the neck of the container, an orientation diametrically opposite that of the handle.

At present, this result is generally obtained with a machine which places the pouring lip element of the stopper by indexing, and later the second element of this stopper is placed by a machine which screws on the second element. This way of proceeding therefore requires that these stoppers be delivered separately to the manufacturers who package the products in containers and that, further, these manufacturers have, in addition to machines for screwing the closing elements on the threaded necks of the containers, machines for placing pouring lip elements exhibiting indexing means specific to the stoppers and containers considered. Placing of these stoppers therefore requires the performance of two successive operations, namely, placing of the pouring lip element with indexing, followed by placing the closing element by screwing.

SUMMARY OF THE INVENTION

This invention aims at remedying these drawbacks. For this purpose, in the stopper to which it relates and which is of the above-mentioned type, starting from the principle that the threads of the necks of the containers considered all have the same angular orientation and that it is easy to give the thread of the closing element a predetermined and constant angular orientation. The two stopper elements that can fit into one another have assembly detachable means, making it possible to assemble them with one another temporarily, with the possibility of rotation relative to one another, before they are placed on the container. On the other hand, means are provided which allow them to be set and positioned angularly relative to one another by relatively simple rotation of a fraction of a turn, this angular positioning being determined as a function of predetermined and constant angular orientions of the threads of the neck of the container and of the closing element of the stopper so that, at the end of screwing of the stopper on the neck of the container, the pouring lip of the pouring lip element has the desired angular orientation diametrically opposite to that of the handle of the container.

Thus, this stopper can be delivered with its two elements preassembled, the angular positioning of the pouring lip element being obtained automatically during screwing of the stopper on the neck of the container since, during this screwing, the pouring lip element is carried in rotation by the closing element in a predetermined angular element relative to this latter which, as the end of the screwing, occupies a predetermined angular position relative to the container.

Therefore, the users of this stopper need not have a specific machine for placing the pouring lip elements on the containers.

According to a simple embodiment of the invention, means making it possible to set and position the two elements of this stopper angularly relative to one another by relative rotation of a fraction of a turn are constituted by two catches oriented in opposite directions, one of which is carried by the closing element and the other of which is carried by the pouring lip element at a spot located on the circular path of the first after preassembly of these two elements.

Advantageously, the detachable assembly means of the two elements of this stopper with the possibility of rotation in relation to one another consist of two circular retaining rings provided on the cylindrical faces opposite the parts of these elements that fit into one another and dimensioned to permit, by elastic deformation, the passage of one over the other during assembly and disassembly of these two elements.

BRIEF DESCRIPTION OF THE DRAWINGS

In any case, the invention will be better understood with the help of the following description, with reference to the accompanying diagrammatic drawing representing, by way of nonlimiting example, an embodiment of this metering pouring lip.

DETAILED DESCRIPTION OF THE INVENTION

Figure 1:
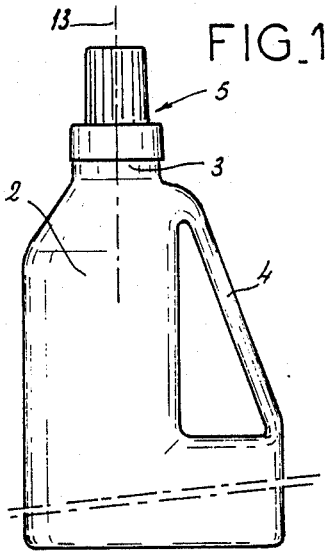
FIG. 1 is a side view in elevation of a container with a threaded neck and lateral handle equipped with this stopper.

FIG. 1 shows a container 2 with threaded neck 3 and lateral handle 3 equipped with stopper 5 according to the invention. This stopper 5 is of the type consisting of two elements namely:

a first element 6 called a pouring lip, which can be engaged and fastened in the open free end of neck 3 of container 2 and including a pouring lip 7;

and a second element 8 called a closing element, comprising a metering chamber 9 and a skirt 11 provided with an inside thread 12 able to be screwed on threaded neck 3 of container 2 to assure its closing.

The mode of using this stopper is the following:

After removal of closing element 8, container 2 is grasped by its handle 4 and pouring lip 7 is placed above metering chamber 9 of closing element 8, held upside down, to perform filling and thus obtain the predetermined dose of the product contained in container 2.

As indicated above, this operation obviously requires that bottom *7a* of pouring lip 7 occupy, on container 2, a position diametrically opposite handle 4 relative to axis of symmetry 13 of threaded neck 3 of container 2.

To eliminate the need of resorting to a machine equipped with indexing means for placing pouring lip element (6), the stopper according to the invention exhibits the two following characteristics:

on the one hand, the two pouring lip element 6 and closing element 8 are equipped with means making it possible to preassemble them with one another temporarily, with the possibility of rotation relative to one another, before they are put in place on threaded neck 3 of container 2;

and, on the other hand, these two elements are equipped with means making it possible to set them and position them angularly relative to one another, by relative simple rotation of a fraction of a turn.

In the example shown in the drawing, the means of preassembly of the two elements 6 and 8 consists quite simply of annular retaining rings, namely:

an annular ring 14 made on the inside cylindrical face of cylindrical part 6a of pouring lip element 6, which can be engaged and fastened in threaded neck 3 of container 2;

and an annular retaining ring 15 made on the outside face of the cylindrical wall of the chamber 9 of closing element 8, which can, by elastic deformation, pass over retaining ring 14 of pouring lip element 6 when the two elements are fitted axially in one another in their position corresponding to the position they would occupy if they were mounted one after other on neck 3 of container 2.

Passing over of retaining ring 14 by retaining ring 15 is made possible by the elasticity of the material constituting each element 6 and 8. These two elements 6 and 8, moreover, can be made of the same material, which is preferably moldable and injectable, such as plastic. It should be also noted that preassembly of the two elements 6 and 8 by retaining rings 14 and 15 is not opposed to their relative rotation.

Figure 3:
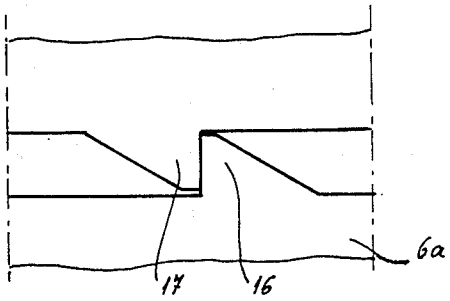
FIG. 3 is a partial view, on an enlarged scale, along arrow III of FIG. 2.
Figure 2:
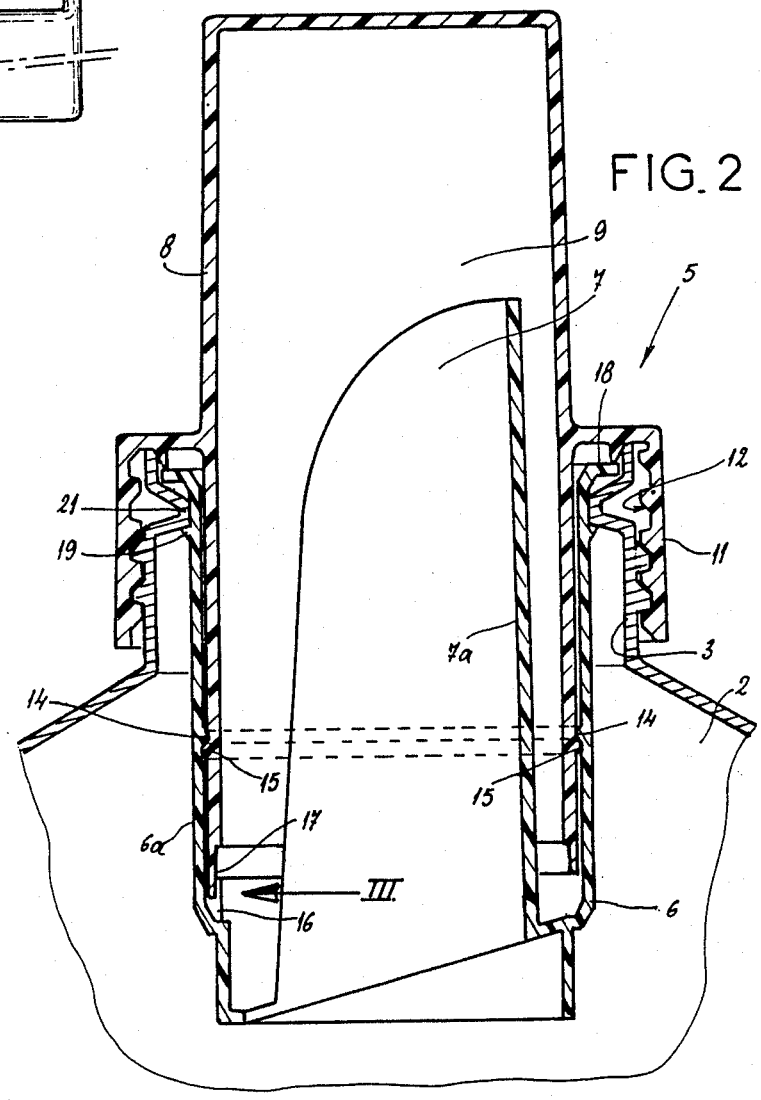
FIG. 2 is a view in axial section along line 13 of this stopper.

In the example shown in the drawing, and particularly, by FIGS. 2 and 3, the means to obtain the setting and angular positioning of elements 6 and 8 by relative rotation are quite simply made up of catches oriented in opposite directions, namely, a catch 16 carried by pouring lip element 6 and a catch 17 carried by closing element 8, catch 16 being positioned in pouring lip element 6 to be located on the circular path of catch 17 when, after preassembly of elements 6 and 8, closing element 8 is carried in rotation relative to pouring lip element 6.

In the example shown in the drawing, catch 17 of closing element 8 is provided as a projection on the free edge of metering chamber 9, while catch 16 of pouring lip element 6 is provided close to the inside edge of the inside face of its cylindrical wall 6a.

It is easy to see that placing this stopper on container 2 is considerably facilitated by the presence of said characteristics of preassembly and angular setting of the two elements 6 and 8. Actually, preassembly first makes it possible to deliver the two elements preassembled with one another. Further, when the user receives this stopper 5 with its two preassembled elements 6 and 8, it suffices for him to have a machine for placing the stopper by screwing, without his also needing to have a machine equipped with indexing means for placing the single element with pouring lip 6. With this machine, it sufficient for him to engage skirt 6a of pouring lip element 6 in threaded neck 3 of container 2 to close and screw skirt 11 of its closing element 8 on threaded neck 3 of container 2. During this operation, fastening by wedging or other, of the pouring lip element 6 in threaded neck 3 of container 2 tends to immobilize it in rotation despite the slight friction force that is exerted on it by closing element 8 whose skirt 11 is to be screwed on threaded neck 3 of container 2. However, during this rotation, necessarily less than one turn, of closing element 8 relative to pouring lip element 6, catch 17 of closing element 8 comes in contact with catch 16 of pouring lip element 6. This latter is necessarily carried in rotation and its angular position in threaded neck 3 of container 2 will be imposed on it by the end of the screwing of skirt 11 of closing element 8 of threaded neck 3 of container 2.

As indicated above, the angular position at the end of screwing of closing element 8 on container 2 is easy to determine since thread 3a of threaded neck 3 of container 2 always occupies the same angular position relative to its handle 4. It therefore suffices to position catches 16 and 17 angularly on their elements 6 and 8, respectively, to obtain the desired angular position of pouring lip 7, diametrically opposite handle 4.

Naturally, it is obviously necessary for catch 17 of closing element 8 itself to be correctly positioned relative to thread 12 of threaded skirt 11 of this element.

Of course, pouring lip element 6 comprises, at the upper end of its cylindrical part 6a intended to be engaged in the threaded neck of container 2, an outside collar 18 intended to limit this engagement by striking against an inside projection 18 of neck 3, which will be described below.

To keep removal of closing element 8 of this stopper 5 also from causing removal of pouring lip element 6 as a result of the action of retaining ring 15 of the first on retaining ring 14 of the second, means for fastening pouring lip element 6 in threaded neck 3 of container 2 advantageously comprise an outside annular rib 19, which is able to engage under an inside annular fold 21, generally made at the free end of threaded neck 3 of container 2 to define the fluidtight zone.

After placing of stopper 5 on threaded neck 3 of container 2, annular fold 21 of this neck therefore is sandwiched between the collar 18 and annular rib 19 of pouring lip element 6, so that this latter is axially immobilized relative to threaded neck 3 of container 2.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A metering pouring stopper for a container, said container having a threaded neck and a lateral handle, said stopper comprising a first element and a second element, said elements being made of a moldable or injectable material which is at least partially elastic and flexible;

said elements being adapted and constructed so as to fit into one another;

said first element comprising a pouring lip to be fastened to a free end of said threaded neck of said container;

said second element comprising a metering chamber and a threaded skirt, said skirt adapted and constructed to be screwed onto said threaded neck of said container;

wherein the said threads on said neck of said container have a predetermined, constant angular orientation, and said two elements have assembly detachable means whereby said elements can be assembled one with another temporarily prior to being placed onto said container;

means are provided whereby said elements can be set and position angularly relative to one another by relative simple rotation of a fraction of a turn;

said angular position being determined as a function of predetermined and constant angular orientation of said threads of said neck and or said second element of a stopper;

whereby when said stopper is completely screwed onto said neck of said container, a pouring lip of said first element has the desired angular orientation diametrically opposite to that of said handle of said container.

2. A metering pouring stopper according to claim 1 wherein the means making it possible to set and position the two elements of said stopper angularly relative to one another by relative rotation of a fraction of a turn comprise a first catch and a second catch, said first catch oriented in a direction opposite to the direction of orientation of said second catch;

said second catch being carried by said second element;

said first catch being carried by said first element at a spot located on the circular path of said second catch after preassembly of said two elements.

3. The metering pouring stopper according to claim 2 wherein the detachable assembly means of said two elements comprises a first circular retaining ring and a second circular retaining ring, said rings located on cylindrical faces opposite the parts of said elements that fit into one another;

said rings being dimensioned to permit the passage of one ring over the other during assembly and disassembly of said two elements.

4. The metering pouring stopper according to claim 1 wherein said first element includes an upper end of a cylindrical part, said part adapted and constructed to be engaged in the threaded neck of said container;

and an outside collar is provided to limit the engagement whereby said collar strikes against an inside projection of the threaded neck of said container.

5. The metering pouring stopper according to claim 1 wherein the means for fastening said first element in said threaded neck of said container comprises an outside annular rib;

said rib adapted and constructed to engage an annular fold at the free end of said threaded neck so as to define a fluidtight zone.

* * * * *